US006909228B2

(12) United States Patent
Igarashi et al.

(10) Patent No.: US 6,909,228 B2
(45) Date of Patent: Jun. 21, 2005

(54) BRAUN TUBE FOR PROJECTORS

(75) Inventors: Takahiro Igarashi, Kanagawa (JP); Tsuneo Kusunoki, Kanagawa (JP); Katsutoshi Ohno, Tokyo (JP)

(73) Assignee: Sony Corporation (JP)

( * ) Notice: Subject to any disclaimer, the term of this patent is extended or adjusted under 35 U.S.C. 154(b) by 87 days.

(21) Appl. No.: 10/356,481

(22) Filed: Feb. 3, 2003

(65) Prior Publication Data

US 2003/0230965 A1 Dec. 18, 2003

(30) Foreign Application Priority Data

Feb. 7, 2002 (JP) ..... P2002-031192

(51) Int. Cl.[7] ..... H01J 29/10

(52) U.S. Cl. ..... 313/461; 313/463; 313/467; 313/485; 313/486; 313/487

(58) Field of Search ..... 313/461, 463, 313/467, 485, 486, 487; 252/301.6 R, 301.6 S, 301.4 S

(56) References Cited

U.S. PATENT DOCUMENTS 4,219,587 A * 8/1980 Oba et al. ..... 427/64
5,256,463 A * 10/1993 Osaka et al. ..... 428/77
5,369,331 A * 11/1994 Mizukami et al. ..... 313/467
5,707,549 A * 1/1998 Matsukiyo et al. ... 252/301.4 R
6,268,691 B1 * 7/2001 Takemura et al. ..... 313/467

* cited by examiner

*Primary Examiner*—Joseph Williams
*Assistant Examiner*—Kevin Quarterman
(74) *Attorney, Agent, or Firm*—Rader, Fishman & Grauer, PLLC; Ronald P. Kananen

(57) ABSTRACT

The present invention proposes a Braun Tube for projectors having an illuminant layer provided on a phosphor screen, the illuminant layer including Zinc Silver Aluminum Oxide (ZnS:Ag, Al) as a blue color illuminant, Yttrium Terbium Silicate (Y2SiO5:Tb) as a green color illuminant, and Yttrium Europium Oxide (Y2O3:Eu) as a red color illuminant, all illuminants having particle size of 5 to 7 $\mu$m. As a result, it is possible to realize a Braun Tube for projectors, in which an extended life cycle is achieved by constraining the degradation of the illuminant, constraining the browning phenomenon, as well as improving the spot size of the electron beam thereof.

1 Claim, 3 Drawing Sheets

20μm

28μm

BRAUN TUBE FOR PROJECTORS

CROSS REFERENCE TO RELATED APPLICATIONS

This application claims priority to Japanese Patent Application No. JP 2002-031192, filed on Feb. 7, 2002, the disclosure of such application being herein incorporated by reference to the extent permitted by law.

BACKGROUND OF THE INVENTION

1. Field of the Invention

The present invention relates to a Braun Tube for projectors. Specifically, the present invention relates to a Braun Tube for projectors, in which an extended life cycle is achieved by constraining the degradation of the illuminant, constraining the browning phenomenon, as well as improving the spot size of the electron beam thereof.

2. Description of the Related Art

In recent years, an enlargement of the size of household television receivers has brought about a demand for sizes up to 50 inches or more. Nowadays, plasma display panels (PDP) have drawn attention as large-sized TVs. However, their high price has inhibited their acquisition by ordinary people, and, in addition, projectors utilizing liquid crystal that projects images on a screen (a front-type liquid crystal projector), projectors utilizing liquid crystal that project an image upon reflecting the image on a screen through a mirror positioned inside the TV set (a rear-type liquid crystal projector) and the like have been drawing attention. Nevertheless, these types of projectors are also expensive.

Front-type as well as rear-type projectors that utilize Braun tubes are inexpensive. Especially, the demand for the rear-type Braun tube projector for consumers has increased because they are less expensive than liquid crystal projectors and in view of the fact that they are able to achieve images of high definition; thus, the demand in the Asian and American markets has increased drastically.

Braun tube projectors have a Braun tube incorporated in the set. Projectors of 7 to 9 inches having a glass screen (phosphor screen) coated with monochromatic red, green and blue illuminants. Nowadays, the 7-inch type is dominant.

Also, in view of the fact that images are projected, it is desirable that the brightness generated from the Braun tube for projectors is as high as possible. In order to increase the brightness, it is necessary to increase the density of electric current to be applied to the Braun tube for projectors to approximately 10 times the direct viewing Braun tube (ordinary, conventional television receivers).

However, the higher the current density applied to the Braun tube for projectors, the more the illuminant deteriorates and the life cycle of the product is reduced. Concomitantly, the spot size of the electron beam originated from the electron gun is increased, thus incurring a problem of degrading the image quality. In addition, conventional Braun tubes for projectors have a great amount of clearances on the illuminant layer formed on the glass screen (phosphor screen), so that the glass screen is directly irradiated by electron beams, thus giving rise to the browning effect in which the glass screen turns out to be pigmented, and constituting another problem that affects the life cycle of the product.

SUMMARY OF THE INVENTION

The present invention has been conceived in order to provide a Braun tube for projectors in which an extended life cycle is attained by constraining the degradation of the illuminant, constraining the browning phenomenon and improving the spot size of the electron beam.

After diligent research, the inventor of the present invention has been able to conclude the invention by attempting to achieve the solution to the above mentioned problems by utilizing a specific illuminant having a controlled particle size of 5 to 7 $\mu$m.

In other words, the present invention proposes a Braun tube for projectors characterized by providing on a phosphor screen an illuminant layer including Zinc Silver Aluminum Oxide(ZnS:Ag, Al) as a blue color illuminant, Yttrium Terbium Silicate (Y2SiO5:Tb) as a green color illuminant and/or Yttrium Europium Oxide (Y2O3:Eu) as a red color illuminant.

It is to be noted that the aims of the present invention cannot be achieved by red, green and blue illuminants utilized in conventional Braun tubes for projectors, as they have particle sizes of 8 to 12 $\mu$m each.

BRIEF DESCRIPTION OF THE DRAWINGS

The above and other features and advantages of the present invention will become more apparent from the following description of the presently preferred respectively embodiments of the present invention taken in conjunction with the accompanying drawings, in which.

DESCRIPTION OF THE PREFERRED EMBODIMENTS

The Braun tube for projectors according to a preferred embodiment of the present invention includes an illuminant layer including Zinc Silver Aluminum Oxide(ZnS:Ag, Al) as a blue color illuminant, Yttrium Terbium Silicate (Y2SiO5:Tb) as a green color illuminant and/or Yttrium Europium Oxide (Y2O3:Eu) as a red color illuminant provided on a phosphor screen and each having a particle size of 5 to 7 $\mu$m as described above. It has to be noted that it is desirable to have a particle size of 5.5 to 6.5 $\mu$m.

Although there is no specific restriction as to the method of forming an illuminant layer, it is possible to adopt a precipitation method, for example. The precipitation method is a method utilizing, for example, a mixture of an illuminant suspension including glass water and an aqueous solution of barium acetate, in which a phosphor layer is formed upon making the mixture have contact with a phosphor screen.

Figure 1:
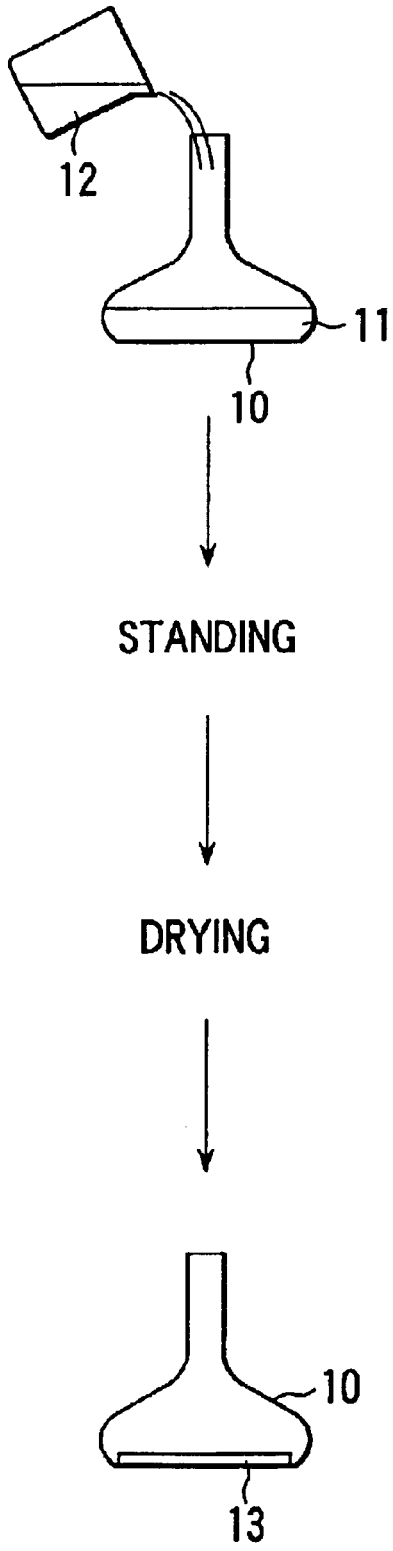
FIG. 1 shows a description of a precipitation method, which constitutes the method of forming an illuminant layer according to the present invention.
Figure 2:
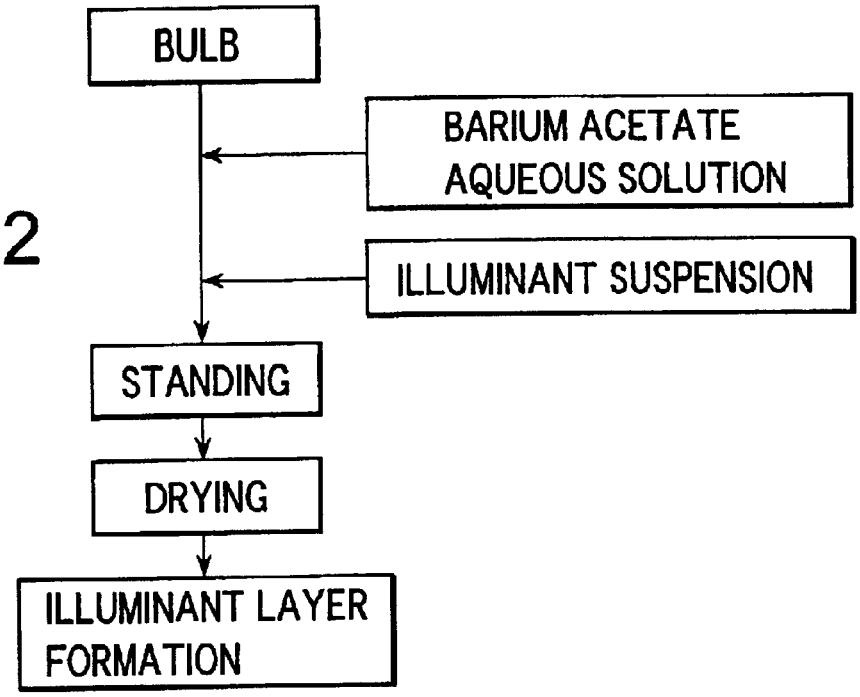
FIG. 2 shows a flowchart of a precipitation method, which constitutes the method of forming an illuminant layer according to the present invention.

FIG. 1 shows a diagram for describing the precipitation method; and FIG. 2 shows a flowchart of the precipitation method. The Braun tube for projectors according to an example of a preferred embodiment of the present invention has a built-in glass screen (phosphor screen) fused to a funnel (hereinafter referred to as bulb).

According to FIG. 1 and FIG. 2, a barium acetate aqueous solution 11 is introduced to the bulb 10, then an illuminant suspension 12 is introduced, and the illuminant adheres to the glass screen upon making the solution stand for 5 to 30 minutes. Subsequently, an illuminant layer 13 is formed upon either air blow (hot air) or vacuum drying. A desirable thickness for the illuminant layer 13 is 15 to 25 μm.

EXAMPLES OF PREFERRED EMBODIMENTS OF THE PRESENT INVENTION

Further description is provided below through examples of preferred embodiments of the present invention.

(1) Preparation of the Illuminant Suspension and the Barium Acetate Aqueous Solution 0.3 to 0.8 g of Y2SiO5:Tb having particle of 6 μm is added to 50 to 80 ml of ion-exchange water. The illuminant suspension is prepared by agitation after the further addition of 10 to 30 g of glass water.

In the present example of preferred embodiment of the present invention, it is assumed that optimum amounts of ion-exchange water, illuminant and glass water are 66 ml, 0.6 g and 18 g, respectively. It is possible that the barium acetate aqueous solution has a concentration of 0.05% to 0.1% by weight. Also, this example of a preferred embodiment has utilized 380 ml of aqueous solution having a concentration of 0.077% by weight.

(2) Formation of the Illuminant Layer

A 7-inch bulb 10 like the one shown in FIG. 1 has been prepared. The barium acetate aqueous solution 11 is thoroughly introduced to the bulb and then the illuminant suspension 12 is thoroughly introduced. The illuminant adheres to the glass screen upon making the solution stand for 5 to 30 minutes. Subsequently, the illuminant layer 13 is formed upon either air blow (hot air) or vacuum drying.

(3) Characteristics of the Phosphor Screen

Figure 3A:
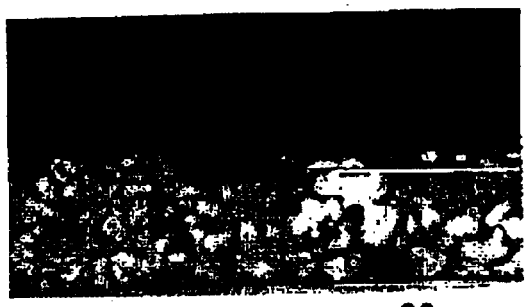
FIG. 3A shows a picture of a cross-sectional view of an illuminant layer formed according to an example of a preferred embodiment of the present invention.
Figure 3B:
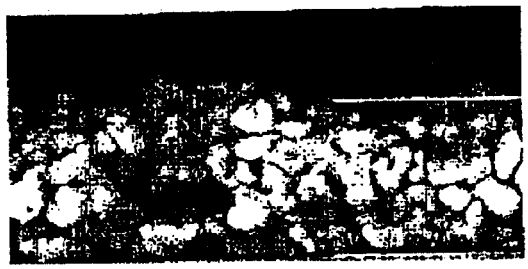
FIG. 3B shows, as an experimental sample, a picture of a cross-sectional view of an illuminant layer obtained when applying the present invention utilizing Y2SiO5:Tb as a conventional green color illuminant having particle size of 8 $\mu$m.

FIG. 3A shows a picture of a cross sectional view of an illuminant layer formed according to the example of the preferred embodiment. FIG. 3B is a picture of a cross-sectional view, an experimental sample of an illuminant layer obtained when applying the present invention utilizing Y2SiO5:Tb as a conventional green color illuminant having particle size of 8 μm. As it can be clearly verified from FIG. 3A and FIG. 3B, the illuminant layer according to the preferred embodiment of the present invention has a thickness of 20 μm, which is thinner than the layer formed utilizing conventional material (28 μm).

From the fact that the illuminant layer is made relatively thinner, it is possible to control a dispersion of electron beams within the phosphor layer (illuminant layer), and thereby the spot size of the electron beam can be reduced by 15% as compared with the case in which a particle size of 8 μm is utilized.

In addition, according to the preferred embodiment of the present invention, the fact that relatively small illuminant particles having particle size of 5 to 7 μm are utilized permits forming a more compact illuminant layer in which an illuminant is provided to the phosphor layer having less or no clearances. As a result, direct electron irradiation over the phosphor screen is avoided, thus constraining the browning effect.

Figure 4:
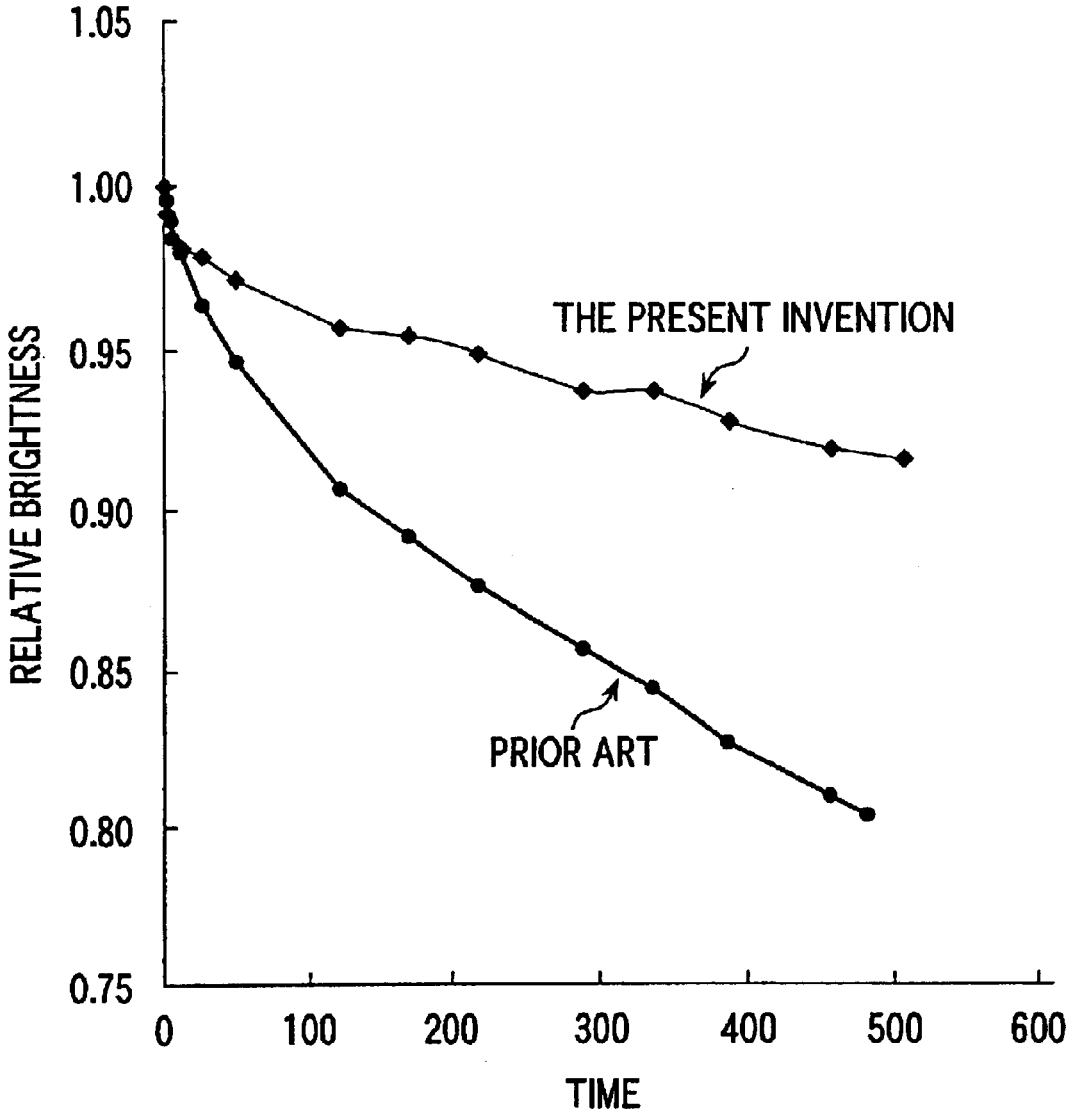
FIG. 4 shows a graphic indicating a result of measurement of life cycle of a green phosphor screen of a Braun tube for projectors manufactured according to an example of a preferred embodiment of the present invention.

FIG. 4 shows a graphic indicating the result of measurement of life cycle of a green phosphor screen of a Braun tube for projectors manufactured according to the example of the preferred embodiment of the present invention. FIG. 4 illustrates the function of relative brightness with respect to time. As can be observed from the figure, the Braun tube for projectors according to the present invention has a life cycle that is several times longer than a conventional Braun tube of the prior art.

It has to be noted that a Braun tube for projectors generally utilizes a high electric current density; thus, the phosphor screen may reach temperatures exceeding 100° C. As a consequence, Braun tubes for projectors are equipped with a cooling mechanism, called a liquid-cooler, for reducing the temperature of the phosphor screen. Although the degradation of the illuminant is accelerated by heat, as the preferred embodiment of the present invention utilizes relatively small illuminant particles having particle size of 5 to 7 μm, the specific surface area is increased, and thus the adhesion between the illuminant and the phosphor screen having the cooling mechanism provided thereon is relatively wide. As a consequence, the cooling efficiency of the illuminant becomes higher, thus permitting an extension to the life cycle of the illuminant.

Although a preferred embodiment of the present invention has been described with reference to an example of an embodiment utilizing a green color illuminant, a similar result can be obtained by utilizing ZnS:Ag, Al having particle size of 5 to 7 μm as a blue color illuminant, Y2O3:Eu having particle size of 5 to 7 μm as a red color illuminant, or still a combination of blue, green and red illuminants.

According to the preferred embodiment of the present invention, it is possible to provide a Braun Tube for projectors, in which an extended life cycle is achieved by constraining the degradation of the illuminant, constraining the browning phenomenon, as well as improving the spot size of the electron beam thereof.

Although the present invention having been described hereinabove in its preferred form with a certain degree of particularity, other changes, variations, combinations and sub-combinations are possible therein. It is therefore to be understood that many modifications will be practiced otherwise than as specifically described herein will be done so without departing from the scope and spirit of the present invention.

What is claimed is:

1. A Braun Tube for projectors comprising an illuminant layer provided on a phosphor screen, the illuminant layer including Zinc Silver Aluminum Oxide (ZnS:Ag, Al) having a particle size of 5.5 μm to 6.5 μm as a blue color illuminant, Yttrium Terbium Silicate (Y2SiO5:Tb) having a particle size of 5.5 μm to 6.5 μm as a green color illuminant, and Yttrium Europium Oxide (Y2O3:Eu) having a particle size of 5.5 μm to 6.5 μm as a red color illuminant.

* * * * *